United States Patent [19]

Gilson et al.

[11] Patent Number: 4,589,633

[45] Date of Patent: May 20, 1986

[54] PROCESS AND INSTALLATION FOR MOULDING A REFRACTORY LINING OF A CONTAINER FOR LIQUID METAL

[76] Inventors: Jacques Gilson, Rue Vieille 15A, 5593 Baronville; Jean M. Thomas, 12 Rue du Village, 5051 Bolinne, both of Belgium; Guy Prioretti, 8 Rue Saint Louis, 54400 Longwy Bas; Pierre Henry, 23 Rue de l'Etang, 54410 Laneuveville Dt Nancy, both of France

[21] Appl. No.: 573,961

[22] Filed: Jan. 26, 1984

[51] Int. Cl.[4] ..... F27D 1/16

[52] U.S. Cl. ..... 266/44; 266/281; 264/30

[58] Field of Search ..... 266/281, 44, 280; 264/30

[56] References Cited

U.S. PATENT DOCUMENTS

| | | | |
|---|---|---|---|
| 3,492,383 | 1/1970 | Heimgartner | 266/281 |
| 3,716,316 | 2/1973 | Dekker et al. | 266/281 |
| 3,944,193 | 3/1976 | Imai et al. | 266/281 |
| 4,455,014 | 6/1984 | Genies | 266/281 |

FOREIGN PATENT DOCUMENTS

| | | | |
|---|---|---|---|
| 2050736 | 2/1971 | France | 266/281 |
| 2095224 | 11/1972 | France . | |
| 0411956 | 9/1974 | U.S.S.R. | 266/281 |
| 0442011 | 11/1974 | U.S.S.R. | 266/281 |
| 0505519 | 5/1976 | U.S.S.R. | 266/281 |
| 0735384 | 5/1980 | U.S.S.R. | 266/281 |

*Primary Examiner*—L. Dewayne Rutledge
*Assistant Examiner*—S. Kastler
*Attorney, Agent, or Firm*—Kane, Dalsimer, Kane, Sullivan and Kurucz

[57] ABSTRACT

The installation comprises a shaping mould 1, 2 adapted to the geometry of the container C and made from a plurality of elements so as to permit a free expansion of the mould in the course of use, arrangements 3, 4, 5 for supporting and handling the mould 2, 3, devices 6, 14 for centering and fixing the mould relative to the container C so as to define between the inner wall of the container C and the mould a space for receiving refractory concrete, and devices 7, 8, 11 for supplying refractory concrete to this space.

19 Claims, 4 Drawing Figures

PROCESS AND INSTALLATION FOR MOULDING A REFRACTORY LINING OF A CONTAINER FOR LIQUID METAL

The present invention relates to the use of unshaped refractory products for providing a lining by moulding for the inner part of containers for liquid metal. The lining may serve as a wear-resistant layer or a safety layer.

In known devices, the lining comprises slabs of refractory product which must be placed in position by means of a mortar so as to form a fluidtight lining, or a refractory concrete applied by spraying or manually with a trowel.

The narrowness of the containers does not always permit a spraying operation and, in any case, the application of the lining requires the complete cooling of the container so as to permit access, when applying the lining, to personnel who must enter the container for the purpose of placing the refractory product in position. The assembly must then be subjected to a drying operation before use and, with some shaped refractory concretes or products, to a pre-heating at a high temperature.

An object of the invention is to overcome the drawbacks of the prior art by providing a process for moulding a refractory lining of containers for liquid metal which requires practically no manual intervention inside the container.

The invention therefore provides such a moulding process which comprises aspirating or injecting the refractory product in the form of an unshaped mass of aggregate between the inner walls of the container and a forming mould previously placed in position in the container, said mould imparting to the deposited aggregate a substantially uniform thickness throughout the parts of the container which must receive the lining.

The use of a mould permits the application of the refractory lining without awaiting the complete cooling of the container after a former use thereof.

The drying of the lining product can then be ensured by providing the mould with a heating device.

The residual heat of the container may also be benefited from.

Another object of the invention is to provide an installation for moulding a refractory lining, in particular of a container for liquid metal, for carrying out the process defined hereinbefore, said installation comprising a mould having a shape adapted to the geometry of the container and made from a plurality of elements so as to allow a free expansion of the mould in the course of use, mould supporting and handling means, mould centering and fixing means relative to the container so as to form between the inner wall of the container and the mould a space for receiving the refractory concrete, and means for supplying refractory concrete to said space.

The accompanying drawings illustrate by way of example an embodiment of the installation according to the present invention.

Figure 1:
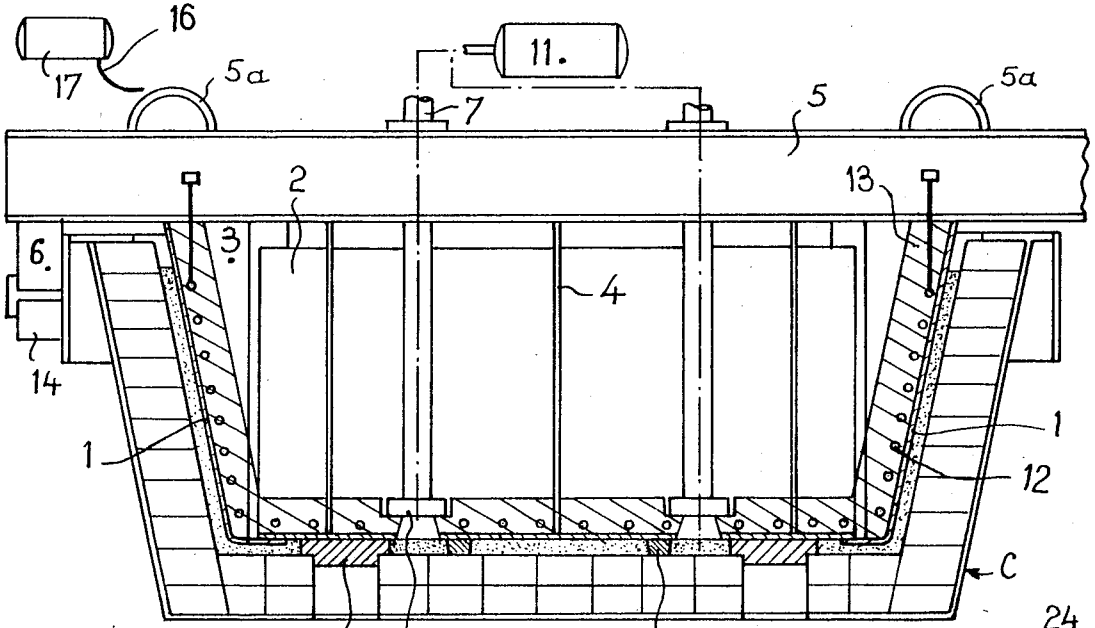
FIG. 1 is a diagrammatic longitudinal sectional view of the installation, showing the various elements, with the mould in position in the container.

The installation represented in FIG. 1 comprises a mould including two fixed elements 1 and a free element 2 supported by stiffeners 3 and flexible strips 4 connected to a handling beam 5 having handling rings 5a and on which are provided centering elements 6 for rendering the thickness of the product uniform, and fixing members 14 for preventing movement of the mould. The free element 2 is disposed between the fixed elements 1.

Its ends overlap the corresponding ends of the fixed elements so that the free element is slidable relative to the fixed parts under the effect of expansion.

The mould elements 1 and 2 have wall means which define the outer surface of the mould.

Supply pipes 7, in a number which varies with the dimensions of the container C, are connected to the bottom of the mould by rapidly disconnected couplings 8 which permit disconnecting the supply before the drying of the product. A supply pipe of this type will be described with reference to FIG. 2.

Detachable elements 9 are provided for protecting the openings and defining if desired places for the baffles 10.

The installation is completed by a vessell 11 receiving the refractory product mixture containing water, the elements of the mixture having been metered before mixing, this vessel being connected to volumetric pumps (not shown) which deliver the product.

Figure 3:
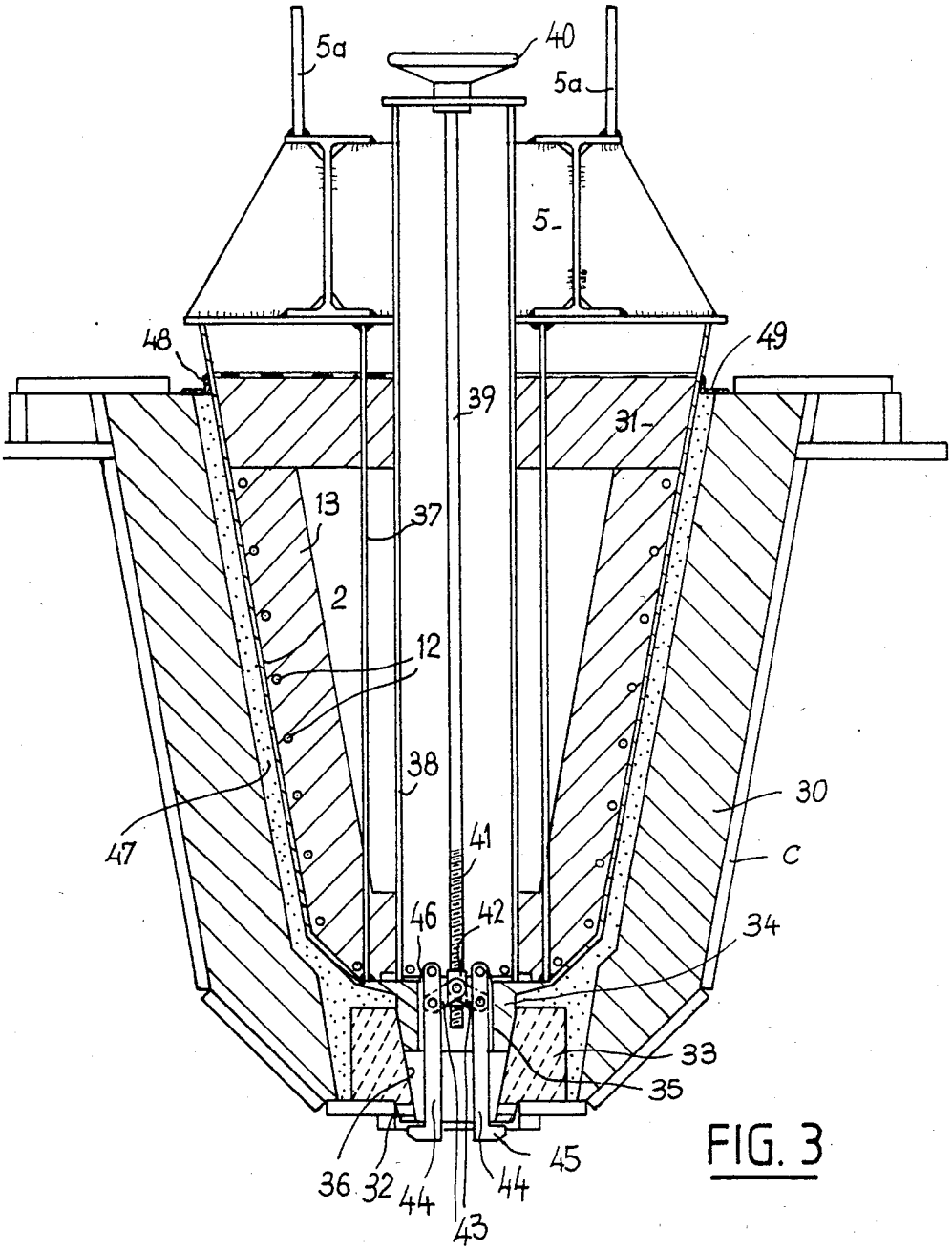
FIG. 3 is a cross-sectional view of a preferred embodiment of the installation showing means for placing in position seat bricks for the pouring orifices.

A system 12 for heating by means of electric resistances is disposed in the wall means close to the out surface of the elements of the mould and protected by a heat insulation 13 on the inside of the mould, as seen in FIGS. 1 and 3.

The electric resistance 12 is formed by a heating cable covered by a mineral insulator constituted by one or more conductive cores embedded in magnesia which is highly compressed within a continuous and fluidtight copper sheath.

At its ends, this cable terminates in cold outputs of large section and low resistivity. The maximum temperature of utilisation is 250° C. Any other suitable heating means may also be employed.

A mould-stripping oil spraying system connected to a tank 17 under pressure is also provided.

Figure 2:
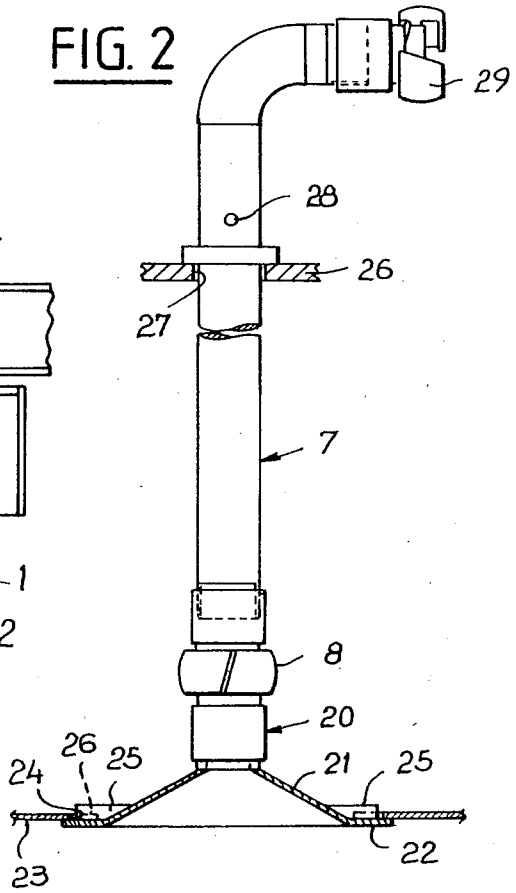
FIG. 2 is an elevational view of a pipe for supplying a mixture of refractory product.

FIG. 2 shows one of the pipes supplying the mixture of refractory product and water of the installation of FIG. 1.

This pipe which has, as in FIG. 1, the reference numeral 7, is rigid and bent in its upper part. It carries at its two ends rapidly disconnected couplings, the coupling 8 ensuring the connection of the lower end of the pipe 7 to a supply end element 20.

The end element has a widely divergent shape and includes a frustoconical portion 21 and an end flange 22 in contact with the lower side of the bottom 23 of the mould. The end element 20 is engaged from below in an orifice 24 formed in the bottom of the mould and includes lugs 25 for preventing rotation thereof and engaged in radial recesses 26 provided in the orifice 24.

The pipe 7 has, at a given distance from the coupling 8, a bearing flange 26 for bearing against a support 27 rigid with the handling beam 5 so that the end element 20 is maintained against the lower side of the bottom 23 of the mould.

Above the flange 26, the pipe 7 has two welded handles 28 for handling the rapidly disconnected coupling 8.

At its end opposed to the coupling 8, the pipe 7 has a similar coupling 29 for connecting the pipe 7 to the pumps of the injection system.

The frustoconical shape of the end element 20 results in an improved flow of the refractory concrete.

A feature of the arrangement just described is the possibility of dismantling the injection pipes from outside the mould and thus easily cleaning them.

FIG. 3 is a cross-sectional view of the installation according to the invention for showing some details of the mould shown in FIG. 1.

The installation represented in FIG. 3 comprises the container C of sheet metal in which is disposed a permanent or safety lining 30 which may be placed in position by the means which will be described with reference to FIG. 4.

Centered in the container provided with its safety layer or lining 30 is a mould similar to that shown in FIG. 1, the free element 2 of which is shown in the region of one of the orifices for pouring the molten metal.

The resistance heating system 12 is disposed in a layer 13 of heat insulating material which is completed by an insulating cover plate 31.

Disposed on the bottom of the container C, in the region of an orifice 32 formed in the latter, is a seat brick 33 the centering of which is ensured by a spigot 34. The latter has a frustoconical outer surface 35 which is in contact with the frustoconical surface of the passage 36 formed in the seat brick 33. Each of the fixed parts 2 of the mould include reinforcements constituted by ribs 37.

Fixed above each centering spigot 34 is a tube 38 in which there is disposed a rotary shaft 39 provided, in its upper part located above the handling beam 5, with an actuating wheel 40 and provided in its lower part with a screwthreaded portion 41 which cooperates with a nut 42 on which are pivotally mounted links 43 pivotally mounted on arms 44 for maintaining the seat brick in position.

The arms 44 are provided at their lower ends with hook portions 45 which extend outwardly and, at their opposite ends, the arms are pivotally mounted on lugs 46 rigid with the centering spigot 34.

The links 43 may also be driven by electric, hydraulic, pneumatic or other means.

Such an arrangement of the mould permits the seat bricks to be placed in position even in a hot container.

The seat bricks 33 are held in position by the two arms 44 so that the exact position of the pouring orifices relative to the mould is defined.

Immersed nozzles (not shown) may be placed in position in the same manner and may be perfectly located with respect to the mould.

FIG. 3 shows the installation according to the invention in which the refractory concrete constituting the wear-resistant lining 47 of the container has been poured and ensures that the seat bricks 33 are held in position.

As is also clear from this Figure, the mould has, on the periphery of its upper part, a sealing element 48 provided with venting orifices 49, this sealing element resulting in a good distribution of the refractory concrete in the gap left between the mould 2 and the safety lining 30.

Figure 4:
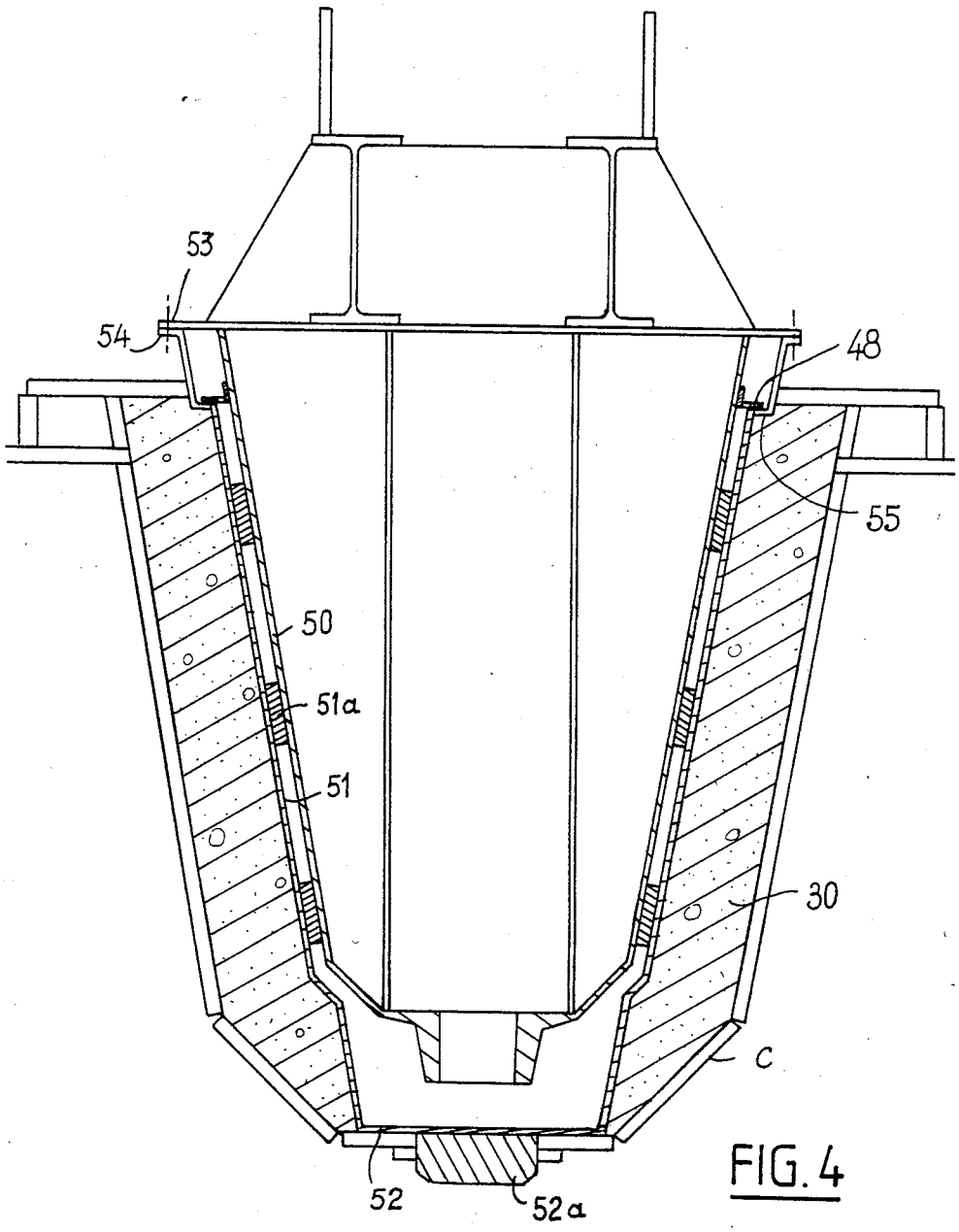
FIG. 4 is a sectional view similar to FIG. 3, of an installation according to the invention provided with an additional mould for the safety lining.

The installation shown in FIG. 4 is adapted to produce in succession, by similar processes, the safety lining and the wear-resistant lining of a container.

This installation comprises a mould 50 for forming the wear-resistant lining similar to the wear-resistant lining mould of the installation represented in FIG. 3.

The wear-resistant lining mould is engaged in a safety lining mould 51 whose shape and dimensions are roughly homothetic to those of the mould 50.

Fixed on the inner wall of the mould 51 are spacer members 51*a* for centering and ensuring the relative spacing between the two moulds and transmitting the moulding forces from the safety lining to the rigid bearing structure supporting the mould.

This arrangement moreover permits the use of a single supporting, bearing and centering structure constituted by the beam 5 and its associated elements and ensures a constant thickness of the wear-resistant lining notwithstanding deformations of the outer case or displacements of the assembly 50, 51 relative to the case of the container C.

The bottom 52 of the safety lining mould is in contact with the bottom of the sheet metal container C in the regions of the seat bricks.

It has in these regions centering projections 52*a* engaged in corresponding orifices 32 in the container C.

Elsewhere, it is located at a distance from the bottom which is equal to the thickness of the lateral lining shown in FIG. 4.

The safety lining mould 51 is secured to the wear-resistant lining mould 50 by fasteners (not shown) which hold together the upper flanges 53, 54 of the respective moulds.

The safety lining mould 51 has in its upper part a step 55 adapted to create, when moulding the safety lining, a bearing surface for the sealing element 48 of the The safety lining is produced in the same way as the wear-resistant lining by the use of the same supply pipes, having rapidly disconnected couplings and frustoconical end elements, for introducing between the mould 51 and the container C a mortar adapted to form this lining.

It is possible to associate with the wear-resistant lining mould a plurality of safety lining moulds of different dimensions so that it is possible to choose the thickness of the wear-resistant lining in accordance with the utilization of the container.

The two moulds 50, 51 constitute a fitted-together assembly so that, when the safety lining 30 is moulded, the mould 51 may be left in position for the hydraulic setting of the safety lining and the wear-resistant lining mould 50 may be used in a neighbouring container.

The installation according to the invention has been described as being applied to the production of linings for pouring distributors.

However, the process employed may also be used for producing:

pouring or transfer ladles,
pouring apertures of converters,
blast-furnace pouring channels,
injection or stirring rods.

These applications are not intended to be limitative.

The use of two fitted-together moulds permits the construction of thin wear-resistant linings for pouring ladles. This makes it possible, for a given overall thickness, to increase considerably the thickness of the thermal insulation lining.

The process of the invention permits the construction of a thicker and more insulating safety lining and a thinner and less insulating wear-resistant lining which however has a much higher strength.

The rapidity of the process enables the wear resistant layer to be more frequently replaced and consequently results in an improved utilization of the ladles or containers.

The unshaped refractory product is a magnesia product or a product of any other type containing a chemical or hydraulic binder which ensures that it sets at the temperatures reached by the heating mould or by that of the container, and a ceramic setting upon contact of the liquid metal. The particle size of the product varies in accordance with its utilization.

It can therefore be seen that, owing to the arrangement just described, a refractory lining may be placed on the walls of a container for liquid metal rapidly and without manual intervention inside the container.

The advantage of this process is that it may be used with any type of unshaped mass of refractory or other concrete. It also permits the construction of insulating wear-resistant and safety linings with the same material.

What is claimed is:

1. A process for moulding a refractory lining in a liquid metal container having inner walls, comprising placing a forming mould inside the container, the mould comprising wall means defining an outer mould surface, introducing a refractory product in the form of an unshaped aggregate between the inner walls of the container and the outer mould surface of the forming mould, said mould surface being such as to impart to the aggregate a substantially uniform thickness throughout parts of the container which must receive the lining, and drying the lining aggregate by heating said outer surface of the mould by means of heating elements disposed within the thickness of said wall means of the mould while heat insulating a side of the heating elements remote from said outer surface.

2. A process according to claim 1, wherein the aggregate is introduced between the inner wall of the container and the mould surface by aspiration.

3. A process according to claim 1, wherein the aggregate is introduced between the inner wall of the container and the mould surface by injection.

4. A process according to claim 1, wherein the introduction of the aggregate between the inner walls of the container and the mould occurs when the container is hot following on a preceding utilization thereof, the residual heat of the container contributing to the drying of the lining aggregate.

5. An installation for moulding a refractory lining in a liquid metal container having inner walls, said installation comprising in combination: a forming mould including wall means defining an outer surface of the mould adapted to the geometry of the container and having a plurality of mould elements movable relative to one another so as to permit a free expansion of the mould in the course of utilization, mould supporting and handling means, means for centering and fixing the mould relative to the container in such a manner as to define between the inner walls of the container and the mould a space for receiving the aggregate, said wall means of the mould including an inner heat insulating layer and heating means interposed between the heat insulating layer and said outer surface of the mould for heating said outer surface of the mould, and means for supplying aggregate to said space.

6. An installation according to claim 5, wherein said mould comprises a handling beam, two fixed elements, stiffeners supporting said two fixed elements and fixed to the handling beam, a free element, and flexible strips supporting said free element and connected to said beam.

7. An installation according to claim 6, wherein the means for centering and fixing the mould relative to the container comprise mould centering members connected to the handling beam and members for fixing the mould to the container.

8. An installation according to claim 5, wherein the means for supplying refractory aggregate to said space comprise pipes fixed to a handling beam and terminating in a region of the wall of the mould in rapidly disconnected couplings, a tank containing the lining product being connected to said pipes.

9. An installation according to claim 5, comprising a mould-stripping oil spraying unit.

10. An installation according to claim 8, wherein the piping fixed to the handling beam is constituted by at least one rigid pipe provided with a bearing flange, a support is connected to the handling beam, against which support said bearing flange is applied, the mould has a bottom defining an orifice and a flared end element is mounted in said orifice and the pipe is connected by said rapidly disconnected coupling to said flared end element and applied by its edge against the lower surface of said bottom.

11. An installation according to claim 10, wherein the end element has lugs for rotationally maintaining the end element in position, said lugs being engaged in notches provided in the orifice of the bottom of the mould.

12. An installation according to claim 5, wherein said mould comprises means for centering seat bricks adapted to define apertures for pouring molten material and means for placing the seat bricks in position before the lining of refractory material is produced.

13. An installation for moulding a refractory lining in a liquid metal container having inner walls, said installation comprising a forming mould adapted to the geometry of the container and having a plurality of mould elements so as to permit a free expansion of the mould in the course of utilization, mould supporting and handling means, means for centering and fixing the mould relative to the container in such manner as to define between the inner walls of the container and the mould a space for receiving the aggregate, and means for supplying aggregate to said space, said mould comprising means for centering seat bricks adapted to define apertures for pouring molten material and means for placing the seat bricks in position before the lining of refractory material is produced, said means for centering comprising a sleeve having a frustoconical outer surface and fixed to the bottom of the mould in downwardly projecting relation to the bottom of the mould and engaged in the aperture in the seat brick which aperture is correspondingly frustoconical, and said means for placing the seat bricks in position comprising a mechanism having maintaining arms articulated to said sleeve, a tube coaxial with said sleeve, a driving shaft having a screwthreaded end portion and disposed in said tube, and a nut articulated to said arms and engaged on said screwthreaded portion for actuating said arms.

14. An installation according to claim 5, wherein said mould includes in an upper part a sealing element provided with venting orifices for ensuring the distribution of the product at the end of the filling.

15. An installation according to claim 5, for forming, in a first step, a safety lining on the inside of the container and then, in a second step, a wear-resistant lining on the inside of the safety lining, said mould being adapted to produce said wear-resistant lining of the container, and the installation further comprising an additional mould for producing said safety lining, said additional mould being of dimensions and shape which are homothetic to said mould for the wear-resistant lining, the mould for producing the wear-resistant lining being selectively disposed inside said additional mould when forming said safety lining with said additional mould and removed from the mould for the wear-resistant lining when forming the wear-resistant lining by means of said mould for the wear-resistant lining, the two moulds being fixed together by fasteners by an upper edge portion thereof and maintained spaced apart by spacer members connected to the mould for producing said safety lining.

16. An installation according to claim 15, wherein a bottom of the additional mould is in contact with a bottom of the container in parts of the container adapted to receive seat bricks and includes projections for centering it relative to the container.

17. A process for moulding, in a first step, a safety lining and, in a second step, a wear-resistant lining in a liquid metal container, said process comprising disclosing in a sheet metal case of the container an interfitting assembly of a mould for forming the safety lining and a mould for forming the wear-resistant lining which is centered relative to said case, the mould for forming the wear-resistant lining comprising wall means defining an outer mould surface, introducing between walls of the case and walls of the safety lining mould a product in the form of an unshaped aggregate for substantially completely forming the safety lining, allowing the product forming the safety lining to set, withdrawing said assembly and removing the safety lining mould from the wear-resistant lining mould and thereafter placing in position the wear-resistant lining mould in the sheet metal case provided on the safety lining and said outer mould surface of said wear-resistant lining mould a refractory product in the form of an unshaped aggregate adapted to constitute substantially the complete wear-resistant lining, drying the wear-resistant lining by heating said outer mould surface of the wear-resistant lining mould by means of heating elements disposed within the thickness of said wall means of the wear-resistant lining mould while heat insulating a side of the heating elements remote from said outer mould surface of the wear-resistant lining mould, and withdrawing said wear-resistant lining mould from the wear-resistant lining.

18. A process according to claim 17, wherein the safety lining mould is fitted on the wear-resistant lining mould and the safety lining mould is placed in position by the engagement in said case of the assembly formed by the two moulds, and the successive supplies of products for forming the safety lining and the wear-resistant lining is ensured by the same product-supplying pipings through the bottom of said moulds.

19. A process according to claim 17, wherein a plurality of moulds for forming the safety lining are provided for the process so as to form different thicknesses of said wear-resistant lining in combination with said wear-resistant lining mould, the selected safety lining mould for use in said interfitting assembly depending on the required thickness of said wear-resistant lining.

* * * * *